US005897403A

United States Patent [19]

Kourimsky

[11] Patent Number: 5,897,403

[45] Date of Patent: Apr. 27, 1999

[54] APPARATUS FOR MAKING CONTACT WITH A CONICAL CONTACT

[75] Inventor: Fritz Josef Alois Kourimsky, Bensheim, Germany

[73] Assignee: The Whitaker Corporation, Wilmington, Del.

[21] Appl. No.: 08/784,626

[22] Filed: Jan. 21, 1997

[30] Foreign Application Priority Data

Jan. 25, 1996 [DE] Germany ..... 196 02 671

[51] Int. Cl.[6] ..... H01R 4/28

[52] U.S. Cl. ..... 439/761; 439/773

[58] Field of Search ..... 439/770, 761, 439/773

[56] References Cited

U.S. PATENT DOCUMENTS

| | | | |
|---|---|---|---|
| 3,829,823 | 8/1974 | Dumesnil | 439/522 |
| 4,537,460 | 8/1985 | McCaig | 439/769 |
| 4,555,159 | 11/1985 | Chartrain et al. | 439/773 |
| 5,254,020 | 10/1993 | Obligar | 439/761 |
| 5,454,741 | 10/1995 | Okada | 439/762 |

FOREIGN PATENT DOCUMENTS

| | | | |
|---|---|---|---|
| 0 278 918-A2 | 8/1988 | European Pat. Off. | H01R 11/28 |
| 0 615 311-A2 | 9/1994 | European Pat. Off. | H01R 11/28 |
| 0 632 531-A1 | 1/1995 | European Pat. Off. | H01R 11/28 |
| 0 653 806-A1 | 5/1995 | European Pat. Off. | H01R 11/28 |
| 913 790 | 6/1954 | Germany | H01R 4/26 |
| 79 33 001 | 3/1980 | Germany | H01R 7/32 |
| 41 38 547-C1 | 11/1992 | Germany | H01R 4/26 |
| 9216774 | 7/1993 | Germany | H01R 4/26 |
| 29506699 | 8/1995 | Germany | H01R 4/26 |
| 29508326 | 9/1995 | Germany | H01R 4/26 |

OTHER PUBLICATIONS

Copy of German Search Report.

*Primary Examiner*—Gary F Paumen
*Assistant Examiner*—T C Patel

[57] ABSTRACT

An apparatus for making contact with a conical contact, in particular a battery terminal, is specified, which apparatus is manufactured from sheet metal by punching and shaping and has two rings of different diameters which each have an opening on one side and are connected to one another by means of two bent clips, one to the left and one to the right of the openings and the apparatus has means for reducing the width of the openings which means engage on the clips at least one further contact making area and has strips arranged on the external side of the rings, respectively at positions lying one opposite the other, the free ends of which strips have a shape which is complementary to the free end of the respective opposite strip, and the free ends, which are shaped in a complementary fashion, of opposite strips bear one against the other.

4 Claims, 2 Drawing Sheets

APPARATUS FOR MAKING CONTACT WITH A CONICAL CONTACT

BACKGROUND OF THE INVENTION

1. Field of the Invention

The invention relates to an apparatus for making contact with a conical contact, in particular an end terminal of a battery for motor vehicles, i.e. a battery terminal.

2. Description of the Prior Art

U.S. Pat. No. 5,454,741 (see FIG. 4), which forms the generic type, discloses a battery terminal of the abovementioned type. A screw with a bolt is provided as means for reducing the width of the openings which engage on the clips. This screw cannot be tightened from above but rather only from the side. It has been found that such an arrangement is unsuitable for mounting by robot. Furthermore, owing to the conical shape of the battery terminal, this known arrangement does not ensure that contact is made satisfactorily.

SUMMARY OF THE INVENTION

The object of the present invention is to specify an apparatus for making contact with a conical contact which ensures contact is made satisfactorily.

The object is achieved by means of an apparatus for making contact with a conical contact, in particular an end terminal of a battery for motor vehicles, which apparatus is manufactured from sheet metal by punching and shaping, comprising two rings which each have an opening on one side and are connected to one another by means of two bent clips, one to the left and one to the right of the openings, comprising means for reducing the width of the openings which engage on the clips, comprising at least one further contact making area, wherein, the two rings have different internal diameters in the non-stressed state, further comprising strips being arranged on the external side of the rings, respectively at positions lying one opposite the other, the free ends of which strips have a shape which is complementary to the free end of the respective opposite strip, and wherein the free ends, which are shaped in a complementary fashion, of opposite strips bear one against the other.

The apparatus has two rings which have different internal diameters in the non-stressed state. As a result, particularly good adaptation of the rings to the shape of a conical contact is ensured. However, it is important to ensure here that the two rings are also arranged coaxially one on top of the other. In order to ensure this, the rings have, on their external side, strips which are respectively located at opposite sides and whose free ends have a shape which is complementary to the free end of the respective opposite strip. The complementary shape ensures that when the apparatus comprising a punched sheet metal component is folded together, the ends of the bent-over strips engage one in the other and, as they are bent further, the rings are pulled into the correct position. In the completely bent state, the shaped free ends of the strips located one opposite the other lie one in the other with their complementary shape.

In order to obtain a contact making apparatus which can be mounted by robot, it is necessary that all the rotatable parts are capable of being activated from above, that is to say in the direction in which the axis of the conical contact is oriented. This is made possible in that two metal arms are attached to one of the clips, which metal arms are each attached to one side of the clip and each attached to the clip near to the fastening point of the clip to the ring. The two metal arms are bent around in such a way that they are engaged around the clips, and at their free ends there is in each arm a hole by means of which an eccentric member is fastened. When the eccentric member is activated, the position of the two clips is affected and the width of the opening between the two clips can thus also be affected.

A satisfactory contact with the conical contact, which remains unaffected even by vibrations, can be ensured. The contact making area which is provided on the apparatus for making contact can be provided for example as a crimping area for crimping on a line. However, it is also possible for a busbar to be fastened to the contact making area. The busbar then serves to distribute the current to various feeder lines.

DETAILED DESCRIPTION OF THE PREFERRED EMBODIMENT

Figure 1:
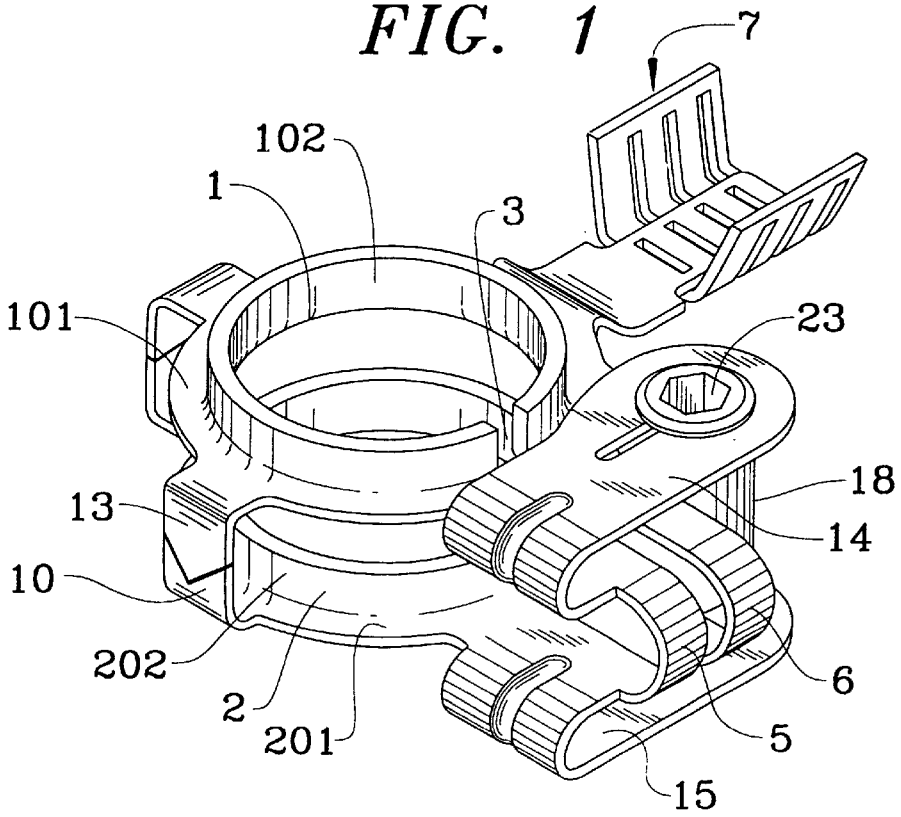
FIG. 1 shows an apparatus according to the invention for making contact with a contact making area which is constructed as a crimping area.

FIG. 1 shows an apparatus according to the invention. The two rings 1 and 2 can be seen, which rings 1 and 2 each have a different diameter and a flat area 101 and 201, as well as a bent-around area 102 and 202 which comes to bear directly against a conical contact. The two rings 1, 2 each have an opening, of which only the opening 3 in the upper ring 1 can be seen. The two rings 1, 2 are connected to one another by means of two clips 5, 6. The clips 5, 6 are each located to the side of the openings 3, 4. The clips 5, 6 are bent around by 180° so that the two rings come to bear one on top of the other. The apparatus has a further contact making area 7 which is constructed as a crimping area. Furthermore, metal arms 14 and 15, which each extend perpendicularly to the clips 5 and 6, are arranged on the clip 5. The metal arms 14, 15 are each bent around by 180° in such a way that the arm 14 located near to the first ring 1 extends above the clips 5, 6 and the arm 15 located near to the second lower ring 2 extends below the clips 5, 6. The two metal arms 14, 15 have at each of their free ends a hole through which an eccentric member 18 is fastened to the free ends of the two metal arms 14 and 15. The eccentric member 18 can be rotated by using a fixed spanner to engage in the hexagon head cap screw 23 and rotate it. As a result of rotation of the eccentric member 18, the two clips 5 and 6 move towards one another, causing the internal diameter of the rings 1, 2 and also the clear diameter of the opening 3, 4 to be reduced. The apparatus can be securely fastened to the conical contact by means of this eccentric member. In this context, the eccentric has the advantage that the contact pressure can be determined by measuring the torque. Furthermore, the apparatus according to the invention has the advantage that a constant contact resistance is prescribed and the tolerances of the cone with which contact is to be made do not affect the contacting force.

Figure 2:
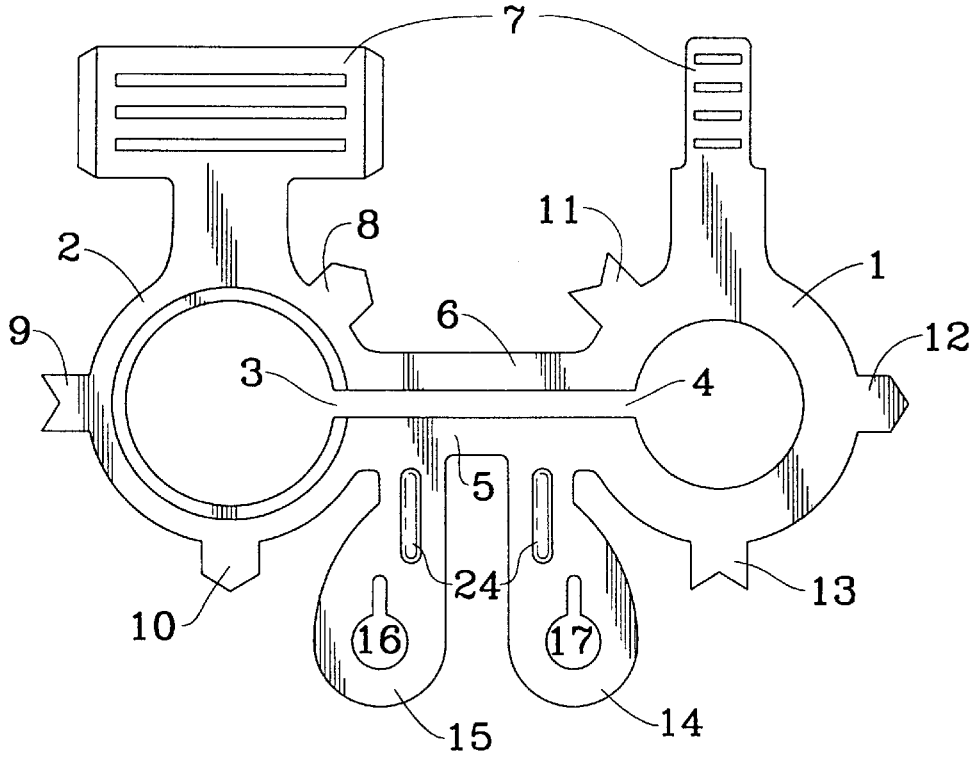
FIG. 2 shows the layout of the punched part according to FIG. 1.

FIG. 2 shows the layout of the apparatus illustrated in FIG. 1. It is possible to see clearly the two parts of the crimping area 7, the two rings 1 and 2 with the openings 3 and 4, and the two clips 5 and 6, the two metal arms 14 and 15 being fastened to the clip 5. The two metal arms 14, 15 have the holes 16 and 17 at their free ends. These holes are provided with an additional slot. The slot serves to permit the hole to spring out or open slightly. The eccentric member is inserted into these holes and is held therein by means of frictional and spring force. Two stamped areas 24 can also be seen in the layout. The said areas 24 are used to affect the stiffness of the two arms. Furthermore, strips 8,9,10,11,12, 13 can be seen in the layout, the said strips 8 to 13 being each arranged at the external circumference of the rings and having at their free ends a shape which is complementary to the corresponding strip which is arranged at the other ring at the respective opposite position. FIG. 1 shows how the two complementary shapes engage one in the other. The particular configuration of these strips is necessary in order to ensure that the two rings with different diameters come to rest quite clearly coaxially one on top of the other. This is ensured by the complementary shape in the form of a point on the one hand and in the form of a recess which receives the point on the other.

Figure 3:
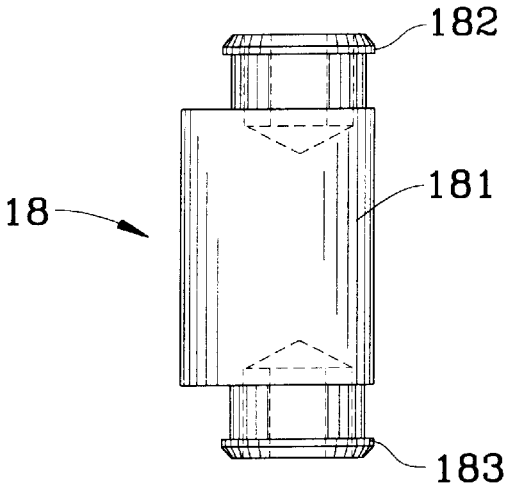
FIG. 3 shows a side view of an eccentric in FIG. 1.
Figure 4:
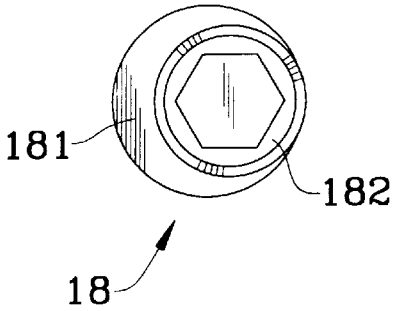
FIG. 4 shows a top view of the eccentric of FIG. 3.

FIGS. 3 and 4 show the eccentric member in more detail. It comprises the eccentric part 181 and the two hexagon cap screw heads 182 and 183. The ends of the metal arms come to rest between the hexagon cap screw heads 182,183 and the eccentric part 181.

Figure 5:
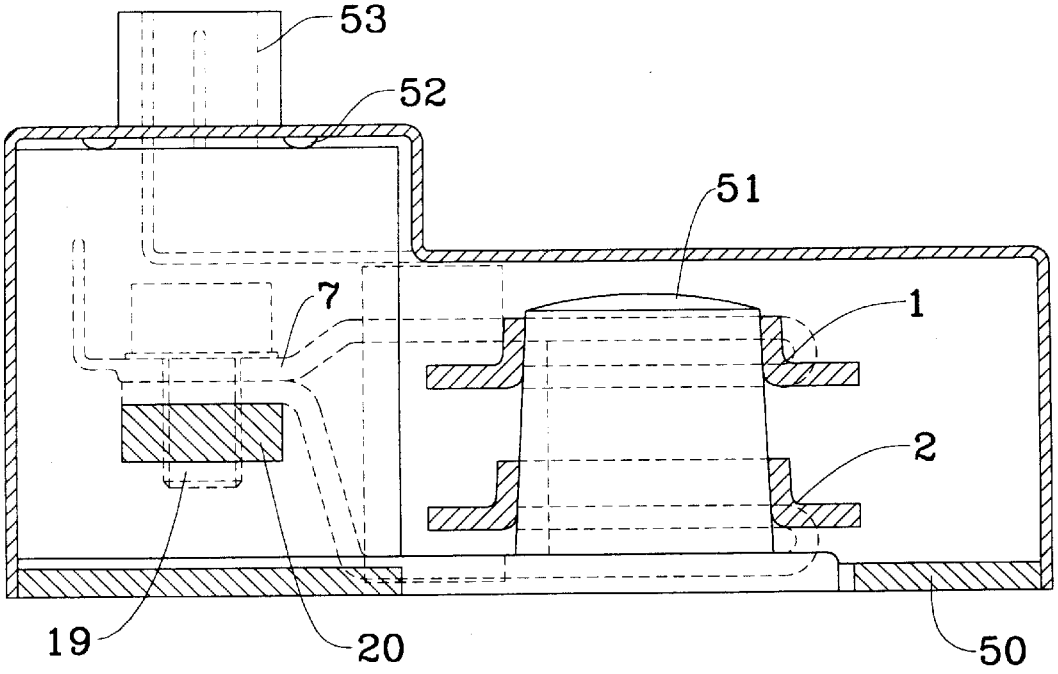
FIG. 5 shows a side view with a partial cross-section of a battery end terminal of the mounted apparatus.

In FIG. 5 it is possible to see an end terminal 51 of a battery for motor vehicles, which end terminal 51 is placed in contact with an apparatus according to the invention having two rings 1 and 2 which are illustrated in section. In the contact making area 7, the two rings are connected to a busbar 20 which distributes the current to various feeder lines via a screw 19. In a housing 50 which surrounds the apparatus, it is also possible to see a sealing ring 52 and a connection 53 which projects from the housing 50.

I claim:

1. An apparatus for making contact with a conical contact, in particular an end terminal of a battery for motor vehicles, which apparatus is manufactured from sheet metal by punching and shaping, comprising: two rings each including an internal contact making area and an opening on one side, the rings are connected to one another by means of two bent clips, one on either side of the openings such that said rings are positioned in stacked alignment with one another; an eccentric member fastened rotatably to the clips and having a longitudinal axis substantially parallel to a longitudinal axis of the conical contact, which cooperates with the clips for reducing the width of said openings, wherein, the two rings have different internal diameters in the non-stressed state and each ring has strips arranged on the external side of the rings, said strips being positioned on each ring so that the strips of each ring lie opposite the strips of the other ring, each said strip having a free end with a shape which is complementary to the free end of the respective opposite strip, and wherein the free ends of opposite strips bear one against the other.

2. The apparatus for making contact with a conical contact as claimed in claim 1, wherein two metal arms which run essentially perpendicularly to the clips are arranged on one of the clips on the side facing away from the other clip, wherein the metal arms are bent around in such a way that they each extend beyond both clips, wherein the metal arms have a hole at each of their free ends, wherein an eccentric member is provided which is arranged between the free ends of the metal arms, is rotatably fastened at the holes and, given a rotational movement, affects the two clips and thus affects the width of the openings.

3. The apparatus as claimed in claim 2, wherein the further contact making area is constructed as a crimping area for crimping on at least one line.

4. The apparatus as claimed in claim 2, wherein a busbar, which distributes the current to various feeder lines, is fastened to the further contact making area.

* * * * *